United States Patent [19]

Das et al.

[11] Patent Number: 4,628,809

[45] Date of Patent: Dec. 16, 1986

[54] RADIAL ORIENTATION RARE EARTH-COBALT MAGNET RINGS

[75] Inventors: Dilip K. Das, Bedford; Kaplesh Kumar, Wellesley; Ernest C. Wettstein, Acton, all of Mass.

[73] Assignee: The Charles Stark Draper Laboratory, Cambridge, Mass.

[21] Appl. No.: 762,708

[22] Filed: Aug. 5, 1985

Related U.S. Application Data

[62] Division of Ser. No. 248,798, Mar. 30, 1981, Pat. No. 4,533,407.

[51] Int. Cl.[4] ..... B30B 15/14

[52] U.S. Cl. ..... 100/208; 29/609; 29/DIG. 95; 100/917; 148/103; 264/DIG. 58; 428/928

[58] Field of Search ..... 29/DIG. 95, 609, 608; 148/108, 105, 103, 102, 120, 121, 122; 419/48, 49, 30, 42, 66, 68; 100/208, 917; 428/928; 264/DIG. 58

[56] References Cited

U.S. PATENT DOCUMENTS

| | | | |
|---|---|---|---|
| 4,104,787 | 8/1978 | Jandeska et al. | 419/8 |
| 4,144,060 | 3/1979 | Jandeska et al. | 419/48 |
| 4,533,407 | 8/1985 | Das et al. | 148/103 |

*Primary Examiner*—Stephen J. Lechert, Jr.
*Attorney, Agent, or Firm*—Weingarten, Schurgin, Gagnebin & Hayes

[57] ABSTRACT

Apparatus and method for forming radial orientation rare earth-transition metal magnets in continuous arc rings by hot isostatic pressing. A method includes the steps of compacting rare earth-transition metal powders having a particle size up to 40 microns into radially oriented rings in a mold provided with a radially aligning field, stacking a plurality of compacted radially oriented rings within an annular cavity within a sealed, evacuated canister to form a cylinder of a predetermined height, subjecting the canister to temperatures in the range of 900° to 1150° C. under a gas pressure of 15 kpsi to densify the compacts, and cooling the canister and the compacts to room temperature. An apparatus for performing the above-described method, includes a mold for forming green compacts having a central iron core or mandrel, as outer housing forming an annular space between it and the iron mandrel, plungers for compacting into a ring rare earth-transition metal powder within the annular space, and means for forming a radially oriented magnetic field. The magnetic field forming means includes a pair of electromagnetic coils with bucking fields disposed on opposite axial ends of the annular space. Ferromagnetic paths guide the flux through the inner and outer walls of the mold and through the powder to form a radial field for powder alignment. A canister is used for forming magnets from the green compacts and the canister is typically composed of a soft iron that will collapse around the magnets and transmit compressive forces to the green compacts for densification thereof. The canister includes an annular space for stacking green compacts bounded by inner and outer walls and an evacuation tube. A central mandrel may be provided if a ring magnet having a predetermined inner diameter is desired.

9 Claims, 4 Drawing Figures

RADIAL ORIENTATION RARE EARTH-COBALT MAGNET RINGS

This is a division of application Ser. No. 248,798, filed on Mar. 30, 1981.

FIELD OF THE INVENTION

This invention relates generally to the formation of rare earth-transition metal magnets and more particularly to the production of radial orientation magnets by hot isostatic pressing.

BACKGROUND OF THE INVENTION

Curved or cylindrical permanent magnets having a radially oriented magnetic field are commonly used in electrical motors and generators, in eddy current devices and in magnetic bearings. The radial orientation of the field permits the full force of the field strength to be directed towards the center of the circle, and this feature is highly desirable in such applications. Typically, these magnets are formed from rare earth-transition metal compounds because such magnets have magnetic energy products markedly higher than those of conventional permanent magnet compounds. Also, in DC motors, the size and weight of the motors equipped with such magnets can be substantially reduced over conventional DC motors which require heavy copper windings or bulky iron poles or ferrite magnets.

In the past, rare earth-cobalt permanent magnets have been formed by a process which involves alignment and die pressing of a powder in a magnetic field to form an aligned compact and subsequent sintering of this compact at temperatures greater than 1100° C. In such magnets, densification to only 93% to 95% of the theoretical maximum is possible, and further densification results in rapid crystal growth which leads to lowered coercivity. This low coercivity is suspected to result from a reasonably large particle size and a high oxygen content. If smaller particle sizes are used, the oxygen content of the magnet is increased because of contamination of the powder by exposure to air, even at room temperatures. Larger particle sizes cannot be used in a sintering process because of inadequate sintering that results from their use. Since the oxygen levels of conventional sintered material are quite high, typically 0.5 to 1.0 weight percent, the coercivity retaining ability of the material is reduced at intermediate temperatures. Examples of magnets formed by this process are described in U.S. Pat. Nos. 3,665,463; 3,919,003; 4,002,508; and 4,076,561. Rare earth-transition metal magnets may also be formed by hot isostatic pressing, as described in U.S. Pat. No. 3,615,915.

Many methods have been tried in the past for forming radially oriented magnets, with few of them being particularly successful. One practice has been to grind into a thin curved shape flat magnets having magnetic domains aligned in a perpendicular direction with respect to their flat surface. Such grinding is timeconsuming and wasteful of relatively expensive rare earth-transition metal materials. Moreover, the direction of magnetic alignment of the resulting magnets is not uniformly radial and is not optimal for the shape of the device in which it is to serve. Another approach has been to deform a flat, sintered slab magnet into a curved shape, as shown for example in U.S. Pat. No. 3,864,808. The flat predensified magnets are heated to a temperature below the sintering temperature of the magnet but at which plastic deformation takes place under pressure exerted by a forming die resting on top of the magnet. However, the magnets must be deformed slowly to prevent them from breaking or distorting and such a process is only effective for shaping very thin, small magnets. Other approaches have been to radially magnetize randomly oriented or isotropic magnets, but the energy product of these magnets is only one-fourth of the theoretical maximum and thus the magnetic field strength is drastically reduced. In other applications, a large number of rectangular, line oriented magnets is assembled along the circumference of a circle, thus providing an approximation of a radially oriented field. The larger the number of magnets used, the more closely true radial orientation is approximated, but the fabrication process is highly labor intensive and thus the cost is high. Additionally, the field can never be totally radially oriented since only the central portion of each rectangle is truly radially aligned. Arc segments in the green compacted state with small included angles and good radial orientation may be produced by conventional pressing, but such segments tend to loose their geometry during sintering. Radial arc segments of up to 114° included angle, with lengths of up to about two inches and thin walls have been produced by die pressing and sintering, as described in U.S. Pat. No. 4,144,060. However, this method is not capable of producing full circle radially oriented magnets because of distortion during sintering. Radial arc segments have also been produced by hot isostatic pressing in a stepwise process described in U.S. Pat. Nos. 4,104,787 and 4,123,297. However, the methods described in these patents do not provide the full circle geometry desired for some applications, nor do they permit the formation of cylindrical magnets of any axial length. In addition, the field produced by these magnets includes fringing field distortions.

SUMMARY OF THE INVENTION

This invention concerns the formation of permanent magnets by hot isostatic pressing and more particularly the formation of circular, radially oriented magnets of any desired axial length. Initially, radially oriented green rings are compacted from a powdered rare-earth-transition metal alloy by plungers moving axially through an annular die. Powder, having a particle size in the range of five to forty microns is utilized in forming the green rings. The powder is produced through conventional grinding techniques under a protective atmosphere. The powder is then packed loosely during the alignment stages to a packing density of about 3.5 $gm/cm^3$ to allow free rotation of the particles. The resulting compacts are generally densified to 60% to 70% of that theoretically possible. This compaction is performed in the presence of a radial magnetic field, so that the individual particles within the rings are aligned in a fully radial orientation during compaction. Once the individual rings are formed by the plungers, they become green compacts of sufficient density to prevent loss of magnetization by particle movement. The rings are then axially stacked to produce a cylinder of desired height. The stacked compacts are placed in a snugly fitting annular cavity inside a canister which is fabricated from soft iron and which has been thoroughly outgassed at an elevated temperature prior to the introduction of the stacked compacts. Then, the canister is covered, and the assembly is evacuated, baked out at 400° and sealed. The entire assembly, including the canister and the green compacts, is hot isostatically pressed in an autoclave at temperatures between 900° and 1150° C. for two to four hours under a gas pressure, typically of argon, at 15 kpsi. The is then cooled to room temperature, and removed from the autoclave. The compacts are compressed into a single uniform magnet cylinder by this process. A diffusion bond is obtained between the stacked rings because of the high pressure at the interfaces therebetween, and the resulting magnet cylinder has as much height as desired. The iron canister has been diffusion bonded onto the magnet cylinder at both its inside and outside diameters. This iron surface may be left on the cylinder or it may be machined off or dissolved in dilute nitric acid.

The apparatus for compacting the rare earth-transition metal powder into green magnets includes a central iron core or mandrel and an outer iron housing forming an annular space therebetween. A plunger is provided at either end for axially compressing the powder within the annular space. A radially oriented magnetic field is impressed on the powder by two electromagnetic bucking coils. The flux is guided by ferromagnetic paths through the inner and outer diameters of the compacting apparatus to form a radial magnetic field for alignment of the powder grains.

The hot isostatic pressing canister may be one of two types. In either type, the canister includes two concentric cylinders forming an annular space therebetween. One canister may be provided with a central solid iron mandrel for producing a magnet cylinder having a predetermined inside diameter. In the other type of canister, no mandrel is provided, and the canister has an open central, cylindrical space. In this canister, compaction occurs along the inside and outside diameters as well as axially so that none of the original dimensions are accurately preserved.

The resulting radially oriented magnet cylinder is compacted to densities over 99% of the theoretical maximum. The oxygen contamination of the resulting magnet is low, and the grain size is small. As a result, high intrinsic magnetic properties are produced in the magnet as compared to other methods, and because of the finer grain size and lower densification temperatures, as compared to conventional sintering techniques, a higher coercivity is produced. Particle sizes of up to 40 microns may be used with good result, as compared with the 5 to 10 micron particle sizes of commercial sintered magnets. At the higher particle sizes, the oxygen content is much lower.

The resulting field has a uniformly radial orientation, and the magnet also has a high mechanical integrity. Magnets produced by this invention are substantially more homogenous and more resistant to property degradation at intermediate temperatures as compared to other previously available sintered magnets. The axial height of the magnet may be as desired, depending upon the number of green compacts placed in the canister.

DESCRIPTION OF THE DRAWINGS

The objects, advantages and features of this invention will be more clearly appreciated from the following detailed description taken in conjunction with the accompanying drawing in which.

DETAILED DESCRIPTION OF THE PREFERRED EMBODIMENT

Figure 1:
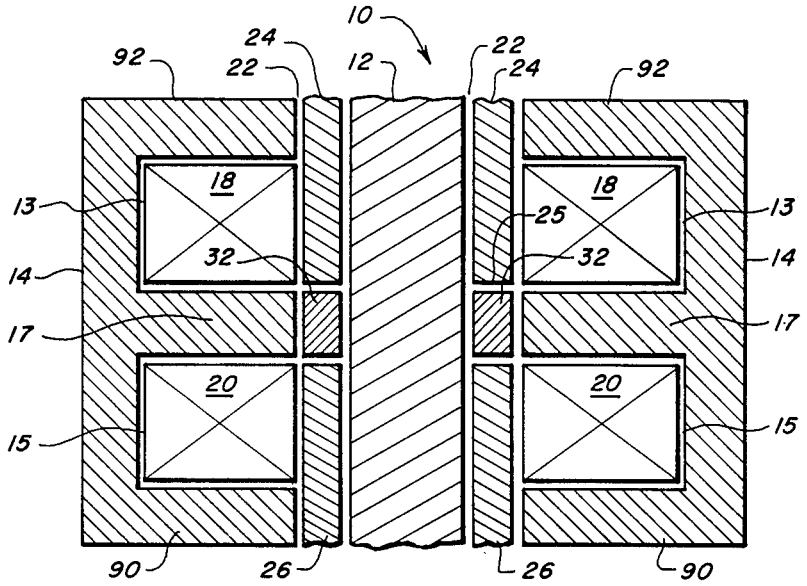
FIG. 1 is a cross-sectional view of die pressing and alignment apparatus used to form green compacts according to the present invention.
Figure 2:
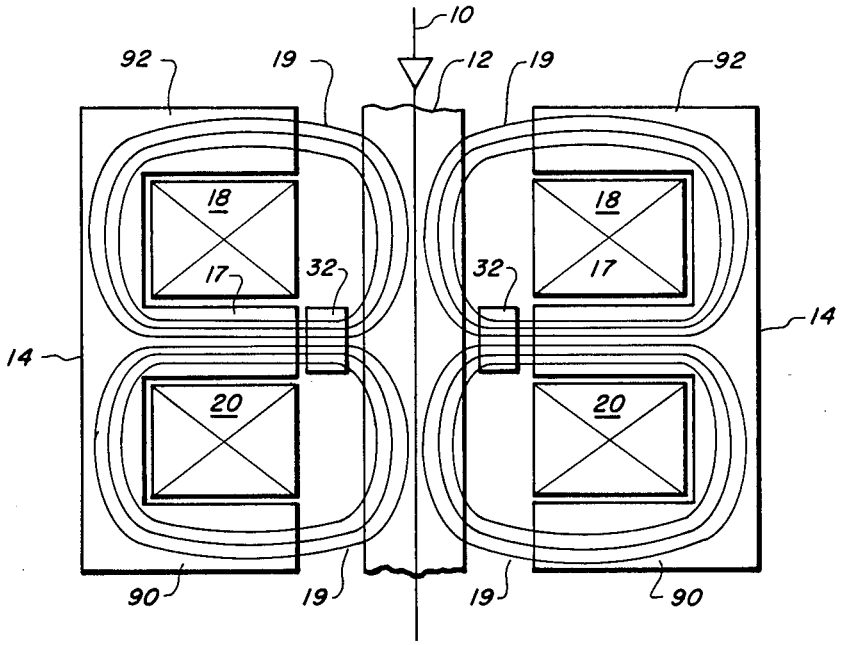
FIG. 2 is a pictorial representation of the magnetic fields of the apparatus of FIG. 1.

This invention relates generally to a method for forming cylindrical, radially oriented magnets, apparatus for implementation of that method and the magnet so formed. The method and apparatus of the present invention produce a cylindrical, radially oriented magnet of any axial dimension having high coercivity and other magnetic properties, having little or no oxygen contamination during densification and being compacted to over 99% of the theoretically possible density. Particle sizes of up to 40 microns are also permitted.

In forming such magnets, a rare earth (RE)-transition metal alloy is typically used, since these alloys are most capable of producing a magnet having the desired properties. Examples of such rare earth-transition metal alloys include $RECo_5$ and $RE_2Co_{17}$, where RE may be samarium. The selected alloy material is first ground into a fine powder through conventional grinding techniques under a protective atmosphere for minimizing contamination such as from environmental oxygen. The size of the individual particles of the powder may be anywhere in the range of five to forty microns, and still produce good results. Typical conventional grinding equipment includes a jaw crusher, a double-disc pulverizer and an attritor. The protective environment is preferably provided by argon gas in the pulverizer and toluene in the attritor, although other inert gases may be used. This rare earth-transition metal powder is loosely packed at this point in the process to a density of typically 3.5 gms/cc to allow free rotation of the individual particles for alignment thereof in an applied magnetic field.

Once the rare earth-transition metal powder is produced, it is compacted into green rings in the presence of an applied radially oriented magnetic field. The loose packing of the powder permits the magnetic field to align the "C" axes of each particle of the hexagonal rare earth-transition metal alloy radially in the direction of the magnetic field. Compaction of the loosely aligned powder is accomplished by die pressing. This die pressing technique is conducted at high pressures using a die and mechanical press with plungers, as will be more fully described. Compaction produces a radially aligned green magnet ring. The resulting green compact or ring has a density of about 60% to 70% of that theoretically possible.

The green compacts are then encapsulated in a metal canister for hot isostatic pressing. Such rings may be stacked in any number to any desired height to produce a resulting magnet having a desired axial length. The compacts are placed in a snugly fitting annular cavity inside the canister, the cavity having been thoroughly outgassed at an elevated temperature prior to their insertion. The canister is preferably fabricated from soft iron or some other material having expansion characteristics identical to those of the fully compacted material or that will yield plastically and relieve any thermal stresses which may build up in the densified material. If such a material is not chosen, the thermal mismatch between the canister and the rare earth-transition metal alloy could produce excessive stresses during subsequent cooling of the canister causing cracks to develop.

Copper may be chosen as a plastically yielding material instead of iron if a barrier of tantalum foil is provided between the green compacts and the copper to prevent contact therebetween. The canister with the compacts therein is covered and the entire assembly is evacuated, baked out at 400° C., and sealed.

The canister is next hot isostatically pressed by placing it in an enclosure such as an autoclave, and by subjecting the canister to a high pressure atmosphere and elevated temperatures. Typically, the gas pressure within the autoclave equals 15 kpsi while the gas utilized is argon, and the gas is heated to between 900° C. and 1150° C. The canister is allowed to remain in this environment for two to four hours. After the autoclave is cooled to room temperature, the canister is removed therefrom. Typically, the compacts have been densified to over 99% of the theoretically possible density, and the individual magnet rings have been diffusion bonded together to form a cylindrical magnet which has a central, cylindrical cavity and which evidences no trace of the original ring interfaces. The soft iron canister also has been diffusion bonded onto the interior and exterior circumstances of the resulting magnet. In some applications, this iron coating may be left on the magnet to serve as a housing. Often, the iron coating is removed in one of three suggested ways. One option is to take off the coating by machining, while another option is to remove the coating by dissolving it in dilute itric acid. Thirdly, a barrier layer of thin tantalum foil may be placed between the canister walls and the green compacts prior to hot isostatic pressing to protect the compacts. Acid is later applied to the cooled, hot isostatically pressed iron canister to dissolve the iron, the reaction ceasing when the acid reaches the tantalum foil. The foil may be then peeled off the hot isostatically pressed magnet, since tantalum does not bond with rare earth-transition metal alloys.

The apparatus for performing the above method will now be described with reference to FIGS. 1 through 4. FIG. 1 shows only the central portion of a typical die press 10 for forming the green compacts. Press 10 includes a central cylindrical mandrel 12 which is typically composed of iron or some other ferromagnetic material. Coaxially disposed about mandrel 12 is a ring 32 of powder to be compacted by die pressing between upper and lower annular plunger rings 24 and 26 respectively which also surround the mandrel 12. Surrounding the compact powder ring 32 and extending axially a substantial distance either side thereof is a core 14 of ferromagnetic material. Core 14 has recesses 13 and 15 above and below the compact ring 32 separated by a partition 17 which abuts the ring 32 of compact powder and extends axially a distance substantially matching the axial extent of the ring 32. The recesses 13 and 15 contain annular magnetic coils 18 and 20 which are wound and energized as bucking coils to produce the magnetic field lines 19 illustrated in FIG. 2. The plungers 24 and 26 are not magnetic, thereby allowing a high concentration of magnetic field to pass through the partition 17 of ferromagnetic material and be directed through the ring 32 of compact powder into the mandrel 12 for return through upper and lower arms 92 and 90 of the core 14.

The dimensions of the ring 32, core 14, coils 18 and 20, plungers 24 and 26, and mandrel 12 are such as to provide close tolerances that prevent escape of the powder within the compact ring 32 during die pressing or compaction of the ring 32. During pressing, it is desirable to control the motion of plungers 24 and 26 such that the ring 32 stays centered at the partition 17 to insure optimum homogeneity in the field 19. This results in correct radial alignment of the C-axes of the powder particles. Because of the rotation symmetry of the structure and field of FIGS. 1 and 2 about the axis of the pressing die 10, the radial symmetry is maintained in the field within the ring 32.

Figure 3:
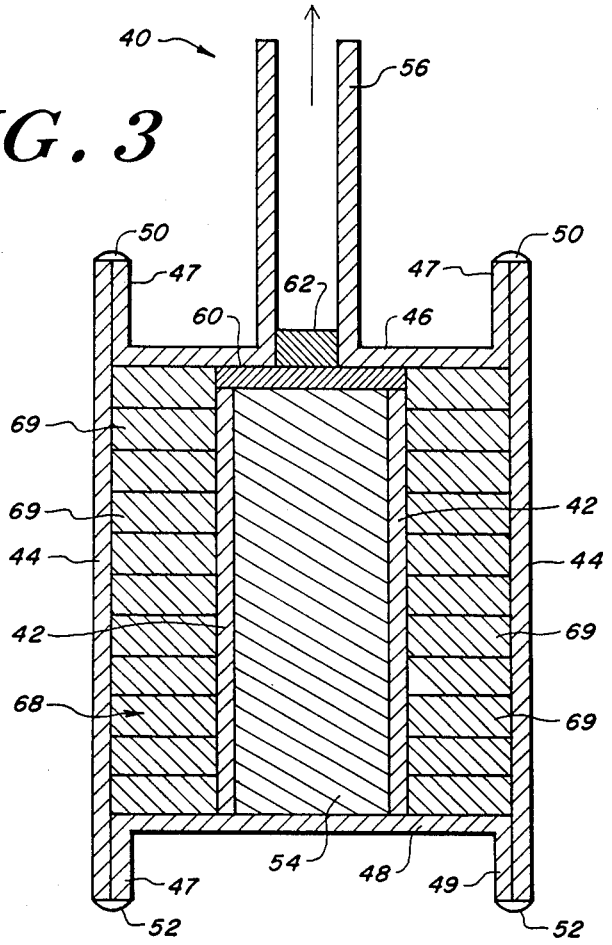
FIG. 3 is a cross-sectional view of a cannister for final forming of the magnets of this invention.
Figure 4:
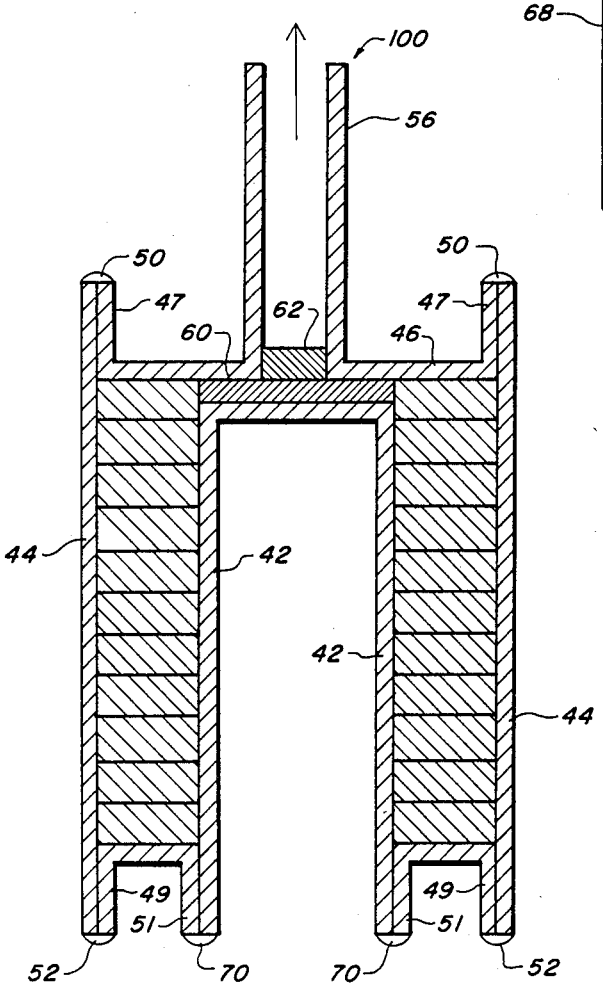
FIG. 4 is a cross-sectional view of an alternative embodiment to the canister of FIG. 3.

FIGS. 3 and 4 show different embodiments of the hot isostatic pressing canister used to densify the green compacts. In FIG. 3, the hot isostatic pressing canister 40 includes an inner cylinder 42, an outer cylinder 44 which is concentric with inner cylinder 42, an upper ring-shaped wall 46 and a lower circular wall 48. Cylinders 42 and 44 form an annular cavity 68 therebetween for placement of the green compacts 69. An upwardly directed outer extension 47 of upper wall 46 is bonded to cylinder 44 along weld 50. Similarly, a downwardly directed outer extension 49 of lower wall 48 is bonded by weld 52 to the inner surface of outer cylinder 44. A cylindrical mandrel 54 is provided within the cylindrical space defined by inner cylinder 42 and is disposed coaxially therewith. Mandrel 54 is composed of a solid, nondeformable material so that as the canister is subjected to high pressures, the radius of inner cylinder 42 will not vary as the diameter of the outer cylinder contracts, thus insuring that the inside radius of the magnetic cylinder so formed is of a predetermined size. Mandrel 54 rests on and is sealed into the cylindrical space by lower wall 48. An evacuation tube 56 is provided on upper wall 46. Tube 56 is used to evacuate and outgas the interior of the canister after the insertion of the green compacts. A layer 60 of spherical iron powder is provided between the top of mandrel 54 and the inner surface of wall 46 after the green compacts are in place. Additionally, a layer of steel wool 62 is provided within evacuation tube 56 just above the layer 60 of spherical iron powder. Once the green compacts have been placed within the canister and the canister has been evacuated and baked out, evacuation tube 56 is sealed. The green compacts 69 are stacked axially within cavity 68 to a height equal to the axial distance between walls 46 and 48, shown in FIG. 3. The axial distance between walls 46 and 48 should be exactly equal to the total axial height of a predetermined number of stacked green compacts so that the fit is snug, and that distance may be varied to suit individual requirements.

FIG. 4 shows a variation of the hot isostatic pressing canister of FIG. 3 in which a central mandrel is not used. In all other respects, the canister of FIG. 4 is identical to that of FIG. 3, and like numbers will be used for like parts where possible. The canister 100 of FIG. 4 includes outer cylinder 44, inner cylinder 42, annular upper wall 46, annular lower wall 48, and evacuation tube 56. Upwardly directed outer extension 47 of upper wall 46 is secured to outer cylinder 44 along weld 50, while downwardly directed outer extension 49 of lower wall 48 is secured to outer cylinder 44 along weld 52. Downwardly directed inner extension 51 of lower wall 48 is secured to inner cylinder 42 along weld 70. A layer 60 of spherical iron powder, and steel wool 62 are provided as in FIG. 3. When canister 100 is subjected to a high gas pressure, compaction occurs along inner cylinder 42 and outer cylinder 44, so that the inside diameter of the resulting magnet is expanded while the outside diameter thereof is contracted. This produces a magnet whose inside diameter cannot be precisely determined.

In the canisters of both FIG. 3 and FIG. 4, compaction also will occur axially between walls 46 and 48.

The use of the canisters of FIGS. 3 and 4 will now be described. In either case, the lower wall 48 is bonded to inner cylinder 42 and outer cylinder 44 prior to insertion of the green compacts. In the canister of FIG. 3, the mandrel has already been inserted into the center of inner cylinder 42, and rests on lower wall 48. The canister and cavity 68 thereof, cover 46 and evacuation tube 56 are each separately outgassed at an elevated temperature, typically 1000° C., and then green compact rings 69 are deposited individually into cavity 68 until they are stacked to the desired axial height. It is important that the rings 69 fit snugly within cavity 68. After insertion of the compacts, the layer 60 of iron powder is placed along the top of mandrel 54, and steel wool 62 is inserted within evacuation tube 56. Then the assembly of wall 46, extension 47 and tube 56 is welded into place to outer cylinder 44 by weld 50. The extension 47 protects the green compacts from heat. Cavity 68 is evacuated through evacuation tube 56 and is baked out at about 400° C. while under vacuum. Cavity 68 next is sealed at evacuation tube 56. The entire assembly is then hot isostatically pressed in an autoclave at temperatures between 900° and 1150° C. for two to four hours under a gas pressure, typically argon, of 15 kpsi. After completion of the hot isostatic pressing process, the canister is allowed to cool and then is removed from the autoclave. Evacuation tube 56 is removed as well as any undesired portions of inner cylinder 42, outer cylinder 44, lower wall 48 or upper wall 46, as previously described. Additionally, if mandrel 54 is used, it is also removed from the center of the finished magnet.

Inner cylinder 42 and outer cylinder 44 are typically composed of a soft iron, although copper may also be used if contact with the compact rings is prevented, as described. Mandrel 54 is typically formed of stainless steel or some other thermally matched material. Core 14 and mandrel 12 are typically composed of iron while coils 18 and 20 typically are electromagnetic coils. Plungers 24 and 26 are preferably composed of strong, non-magnetic alloys such as copper-beryllium. The rare earth-transition metal alloy typically used for formation of the radial magnets is $SmCo_5$. The dimensions of the canister or of the magnets or of any of the other components may be as large or as small as desired. The limits on size are primarily ones of the size of the available autoclave, and ease of use of the canister and of removal of the finished product from therein. The magnetizing field produced by coils 18 and 20 is typically 20 kOe, although a greater power field may be used.

It is desirable that the particle size of the rare earth-transition metal powder be less than 10 microns, although particles as large as 40 microns have been used with good results. If very little grain growth is desired, the temperatures present during the hot isostatic pressing process should not exceed 975° and preferably should not exceed 950° C. Temperatures below 975° inhibit grain growth and maintain a low grain size preferable for high powered magnets. However, the method and apparatus of this invention permit the use of particle sizes of up to 40 microns which is much larger than that permitted in most prior art techniques. In most prior art processes, the particle sizes must be much smaller to get proper desired densification and alignment by sintering. Larger particle sizes are sometimes desirable because the oxygen content thereof is lower, and the lower the oxygen content of the finished magnet, the more stable the expected performance. Typically, in the five to ten micron particle sizes which are used in prior art sintering, the oxygen content is 0.6%, while in 40 micron size particles the oxygen content is only 0.2%. These larger particle sizes give nearly as good results in this invention, including the power and coercivity of the magnet, as the sintered magnets using much smaller particle sizes, and yet these magnets have a lower oxygen content than most prior art magnets which gives them the added quality and retention of coercivity at intermediate temperatures. If larger particle sizes are used in the present process, the magnet must be heat treated after it has been allowed to cool from the hot isostatic pressing. Preferably, the heat treatment is done at 900° C., although 950° C., 1050° C. and 1100° C. may also be used. The time necessary shortens from 66 hours for 950° C. to 24 hours for 1050° C. to 3 hours for 1100° C. Some grain growth occurs, but not enough to significantly alter the magnetic properties. Heat treatments are given to hot isostatically pressed magnets with smaller particle size powder also to significantly improve their properties.

Typically, the rare earth-transition metal powder after grinding has a tap density of about 40% of that which is theoretically possible, and the green compacts typically have a densification of about 65%. After the compacts are formed into the magnet, the resulting product has a densification approaching 100%, and an oxygen level less than 0.3%, the oxygen level depending upon the particle size of the powder. It is desirable to have both a high B and a high H although in the past with radial magnets, this has not been possible. The present invention permits high maximum energy product or $(BH)_{max}$ products, typically of 19 mGOe. Such high energy values are not possible with isotropic magnets. High coercivities or $H_{ci}$ values are produced, typically greater than 35 kOe, as compared to 15–30 kOe for commercial sintered magnets. High values of $H_k$ are also found in magnets produced by this invention. $H_k$ is a measure of the loop squareness and is the value of the reverse magnetic field corresponding to 90% of remanence in the second quadrant of the demagnetization plots. $H_k$ values are typically greater than 15 kOe as compared to 5 to 10 kOe for commercial sintered magnets. The resulting magnet has a high mechanical integrity and is considerably more homogeneous than the prior art sintered magnets and therefore has a much higher coercivity retaining ability at intermediate temperatures as compared to sintered magnets.

The apparatus described above for implementing this method is only exemplary, and other apparatus may be used, and modifications and improvements will occur within the scope of this invention. The above description of the method also is intended as exemplary only, the scope of the invention being as defined in the following claims.

What is claimed is:

1. A die press for forming radially-oriented compacted rings from rare earthtransition metal alloy powder, comprising:

a housing of ferromagnetic material, said housing having a first cylindrical channel therethrough, and also possessing two axially spaced annular recesses surrounding said first cylindrical channel, said recesses defining an annular partition of material of said housing therebetween;

two opposing plungers of nonmagnetic material, sized to fit within said first cylindrical channel from opposite ends thereof, said annular plunger each possessing a second cylindrical channel axially therethrough and an end which is insertable into said first cylindrical channel;

a cylindrical mandrel of ferromagnetic material, sized to fit within said second cylindrical channel;

two annular electromagnetic bucking coils, said bucking coils being located in said annular recesses in said housing, and producing a radially oriented magnetic field at said annular partition of said housing; and means for forcing the opposing ends of said annular plungers together within said housing.

2. A canister for the formation of radially oriented ring magnets of any desired length from a plurality of radially oriented green compacts in the form of unitary rings, comprising:

an outer cylinder having upper and lower ends;

an inner cylinder coaxial with said outer cylinder;

said outer cylinder and said inner cylinder defining an annular cavity therebetween adapted to contain a plurality of axially stacked green compacts;

an upper wall integral with the upper end of said outer cylinder;

a lower wall integral with the lower end of said outer cylinder;

a sealable evacuation tube for removal of gases from said annular cavity, said tube being attached to either of said upper and said lower walls; and a cylindrical mandrel disposed within said inner cylinder and having an outer diameter substantially equal to the inner diameter of said inner cylinder;

said outer cylinder, said inner cylinder, said upper wall, and said lower wall being formed of a material having expansion characteristics compatible with those of the green compacts in a densified magnetic state.

3. A canister for the formation of radially oriented ring magnets from a plurality of radially oriented green compacts in the form of unitary rings, comprising:

an outer cylinder having upper and lower ends;

an inner cylinder coaxial with said outer cylinder and having upper and lower ends;

said outer cylinder and said inner cylinder defining an annular cavity therebetween adapted to contain a plurality of axially stacked green compacts;

a first upper wall integral with the upper end of said outer cylinder;

a second upper wall integral with the upper end of said inner cylinder;

an annular lower wall integral with the lower ends of said outer cylinder and said inner cylinder; and a sealable evacuation tube for removal of gases from said annular cavity, said tube being attached to said first upper wall;

said outer cylinder, said inner cylinder, said first upper wall, said second upper wall, and said annular lower wall being formed of a material having expansion characteristics compatible with those of the green compacts in a densified magnetic state.

4. The canister of claim 3 wherein said outer cylinder, said inner cylinder, said first upper wall, said second upper wall, and said annular lower wall are formed of soft iron.

5. The canister of claim 3 wherein said outer cylinder, said inner cylinder, said first upper wall, said second upper wall, and said annular lower wall are formed of copper having a tantalum lining for preventing contact between the green compacts and the copper.

6. The canister of claim 3, further comprising:

a layer of spherical iron powder positioned between said green compacts and said evacuation tube; and a layer of steel wool within said evacuation tube adjacent said layer of spherical iron powder.

7. The canister of claim 2 wherein said outer cylinder, said inner cylinder, said upper wall, and said lower wall are formed of soft iron.

8. The canister of claim 2 wherein said inner cylinder, said outer cylinder, said upper wall, and said lower wall are formed of copper having a tantalum lining for preventing contact between the green compacts and the copper.

9. The canister of claim 2 further comprising:

a layer of spherical iron powder positioned between said green compacts and said evacuation tube; and a layer of steel wool within said evacuation tube adjacent said layer of spherical iron powder.

* * * * *

UNITED STATES PATENT AND TRADEMARK OFFICE

CERTIFICATE OF CORRECTION

PATENT NO. : 4,628,809

DATED : December 16, 1986

INVENTOR(S) : Dilip K. Das; Kaplesh Kumar; Ernest C. Wettstein

It is certified that error appears in the above-identified patent and that said Letters Patent is hereby corrected as shown below:

Column 1, line 59, "timeconsuming" should read --time consuming--

Column 3, line 4, "The is" should read --The canister is--

Column 5, line 28, "itric" should read --nitric--

Column 8, line 59, "earthtransition" should read --earth-transition--

Signed and Sealed this

Seventh Day of June, 1988

*Attest:*

DONALD J. QUIGG

*Attesting Officer*

*Commissioner of Patents and Trademarks*